US005697619A

United States Patent [19]

Fierle

[11] Patent Number: 5,697,619

[45] Date of Patent: Dec. 16, 1997

[54] RADIAL SEAL FOR AIR PREHEATERS

[75] Inventor: Kurt M. Fierle, Wellsville, N.Y.

[73] Assignee: ABB Air Preheater, Inc., Wellsville, N.Y.

[21] Appl. No.: 625,559

[22] Filed: Apr. 1, 1996

[51] Int. Cl.[6] ..... F16J 15/32; F23L 15/02

[52] U.S. Cl. ..... 277/12; 277/152; 277/236; 165/9

[58] Field of Search ..... 277/12, 152, 192, 277/236; 165/9, DIG. 20, DIG. 21, DIG. 26

[56] References Cited

U.S. PATENT DOCUMENTS

| | | | |
|---|---|---|---|
| 2,650,074 | 8/1953 | Ballard | 165/9 |
| 2,670,183 | 2/1954 | Hammond et al. | 165/DIG. 26 |
| 3,166,119 | 1/1965 | Bellows | 165/9 |
| 4,593,750 | 6/1986 | Finnemore | 165/9 |
| 4,673,026 | 6/1987 | Hagar et al. | 165/9 |
| 4,997,028 | 3/1991 | Townsend | 165/9 |
| 5,005,634 | 4/1991 | Reeves et al. | 165/9 |

FOREIGN PATENT DOCUMENTS

| | | | |
|---|---|---|---|
| 0231396 | 12/1984 | Japan | 165/9 |
| 0251391 | 12/1985 | Japan | 165/9 |

*Primary Examiner*—William A. Cuchlinski, Jr.
*Assistant Examiner*—John L. Beres
*Attorney, Agent, or Firm*—Alix, Yale & Ristas, LLP

[57] ABSTRACT

A rotary regenerative air preheater having a rotor mounted to a central rotor post for rotation within a surrounding housing whereby heat absorbent material carried in the rotor is alternately exposed to a flow of heating gas and a gas to be heated. A radial seal assembly including a flexible sealing strip is mounted to the hot end edge of each radially extending partition of the rotor to establish a seal between the partitions and the confronting face of the sector plate of the housing as the rotor is rotated. The flexible sealing strip has a tapered configuration such that the distal edge of the sealing strip and the confronting face of the sector plate define a controlled radially extending gap when the air preheater is in a hot-operating condition. A protective tip is mounted on the distal edge of the flexible sealing strip to prevent premature failure due to edge fracturing. The rigid back support leaf biases the flexible sealing strip, pretensioning the flexible sealing strip to eliminate gapping due to gas-air pressure differentials.

16 Claims, 6 Drawing Sheets

RADIAL SEAL FOR AIR PREHEATERS

BACKGROUND OF THE INVENTION

The present invention relates to rotary regenerative air preheaters which employ radial seals and more particularly to a novel radial seal that reduces the leakage gaps between the air preheater rotor and the sector sealing surface.

A rotary regenerative air preheater transfers sensible heat from the flue gas leaving a boiler to the entering combustion air through regenerative heat transfer surface in a rotor which turns continuously through the gas and air streams. The rotor, which is packed with the heat transfer surface, is supported through a lower bearing at the lower end of the air preheater and guided through a bearing assembly located at the top end for most vertical flow air preheaters. Some vertical flow air preheaters use a top support bearing and a lower guide bearing. Horizontal flow air preheaters utilize support bearings on each end. The rotor is divided into compartments by a number of radially extending plates referred to as diaphragms. These compartments are adapted to hold modular baskets in which the heat transfer surface is contained.

The air preheater is divided into a flue gas side or sector and one or more combustion air sides or sectors by sector plates. Flexible radial seals on the rotor, usually mounted on the top and bottom edges of the diaphragms, are in close proximity to these sector plates and minimize leakage of gas and air between sectors. Likewise, axial seal plates can be mounted on the housing between the housing and the periphery of the rotor between the air and gas sectors when used. These axial seal plates cooperate with flexible axial seals mounted on the outer ends of the diaphragms. These axial seals and seal plates together with the radial seals and sector plates effectively separate the air and flue gas streams from each other.

In a typical rotary regenerative heat exchanger, the hot flue gas and the combustion air enter the rotor shell from opposite ends and pass in opposite directions over the heat exchange material housed within the rotor. Consequently, the cold air inlet and the cooled gas outlet are at one end of the heat exchanger, referred to as the cold end, and the hot gas inlet and the heated air outlet are at the opposite end of the heat exchanger, referred to as the hot end. As a result, an axial temperature gradient exists from the hot end of the rotor to the cold end of the rotor. In response to this temperature gradient, the rotor tends to distort and to assume a shape similar to that of an inverted dish (commonly referred to as rotor turndown). As a result, the radial seals mounted on the hot end of the diaphragms are pulled away from the sector plates of the housing with the greater separation occurring at the outer radius of the rotor. This opens a gap which allows flow and results in an undesired intermingling of the gas and the air.

Various schemes have been developed to reestablish contact or close proximity between the seal leaves mounted to the diaphragms and the sector plates. It is well known to utilize a flexible sealing member that extends across the gap between the diaphragms and the sector plates. As the rotor transitions from a non-operating condition to an operating condition, the temperature gradient along the rotor increases, and the gap between the hot end diaphragms and the sector plates increases. However, the flexible sealing member is designed to always maintain contact with the sector plate. Such seal designs are classified as "soft touch seals".

Soft touch seals are subject to a number of problems. It has been experienced that the continuous contact between the sealing member and the sector plates results in wear to both the sealing member and the sealing surface of the sector plates. Special liners are sometimes utilized to reduce sealing surface wear. However, use of such liners results in higher capital and labor costs. In addition, deflection of soft touch seals due to pressure differentials between the gas and air sectors is generally not taken into consideration and cause gaps or an increase in gaps. Further, soft touch seals are subject to premature failure due to edge fracturing. Finally, the design of many soft touch seals contain one or both of the following limitations: 1) the amount of gap that may be closed is limited; and 2) each sealing member comprises multiple seal leaves that butt together and leakage may occur at these butt joints.

SUMMARY OF THE INVENTION

The present invention provides an arrangement of means in an air preheater for maintaining a controlled gap between the flexible sealing member and the sector plate at full load operating conditions. This reduces leakage and sealing surface wear. The present invention also provides means in an air preheater to eliminate gapping between the sealing surface and the flexible sealing member due to deflection caused by gas pressure differentials, means for preventing premature failure due to edge fracturing of the flexible sealing member, and means for eliminating gaps between adjacent segments of the flexible sealing member.

DESCRIPTION OF THE PREFERRED EMBODIMENTS

Figure 1:
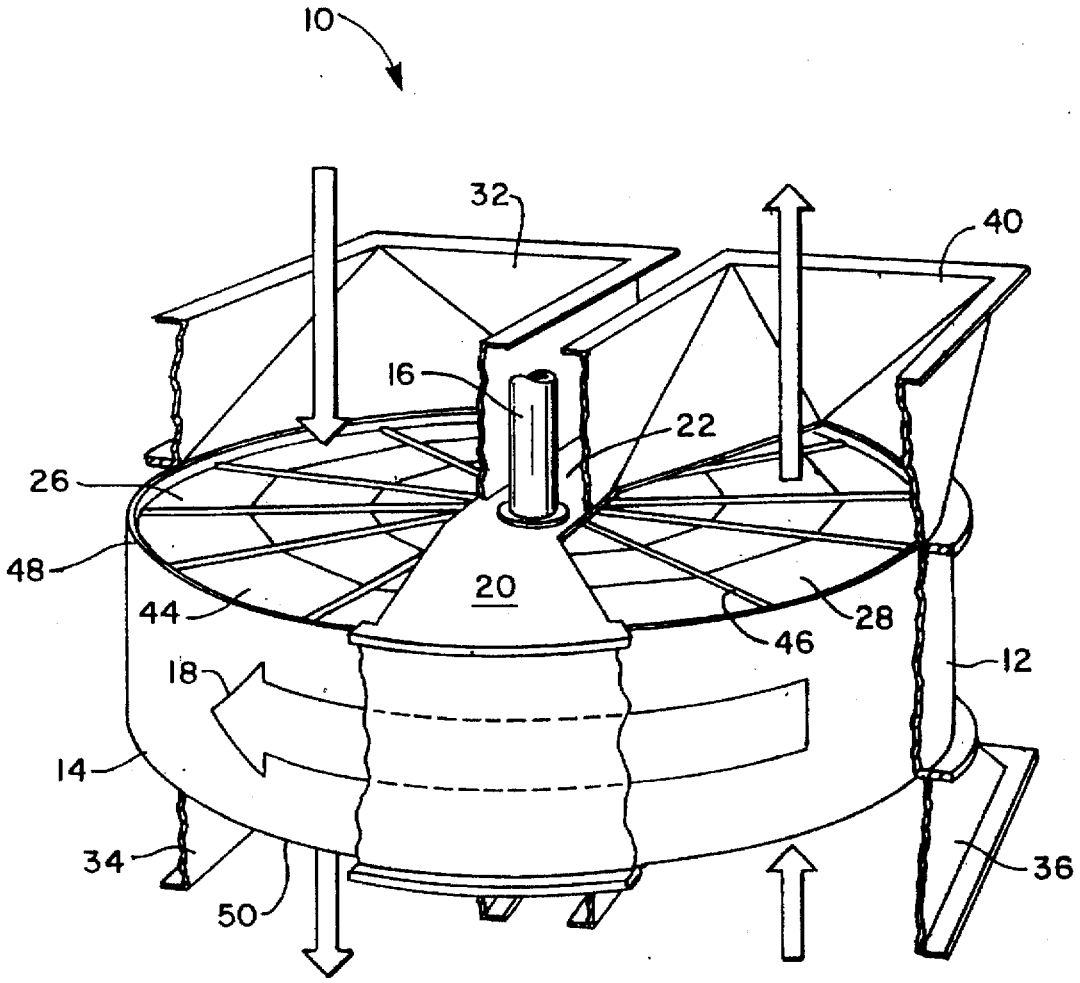
FIG. 1 PRIOR ART
FIG. 1 is a general perspective view of a conventional rotary regenerative air preheater.

FIG. 1 of the drawings is a partially cut-away perspective view of a typical bi-sector air preheater 10 showing a housing 12 in which the rotor 14 is mounted on a drive shaft or post 16 for rotation as indicated by the arrow 18. The housing is divided by means of the flow impervious sector plates 20, 22 into a flue gas side 26 and an air side 28. Corresponding sector plates are also located on the bottom of the unit. The hot flue gases enter the air preheater 10 through the gas inlet duct 32, flows through the sector where heat is transferred to the heat transfer surface in the rotor 14 and then exits through gas outlet duct 34. As this hot heat transfer surface then rotates through the air sector 28 the heat is transferred to the air flowing through the rotor from the air inlet duct connector 36. The heated air stream forms a hot air stream and leaves the air preheater 10 through the duct connector section 40. Consequently, the cold air inlet and the cooled gas outlet 34 define a cold end of the heat exchanger and the hot gas inlet 32 and the heated air outlet define a hot end of the heat exchanger.

Figure 2:
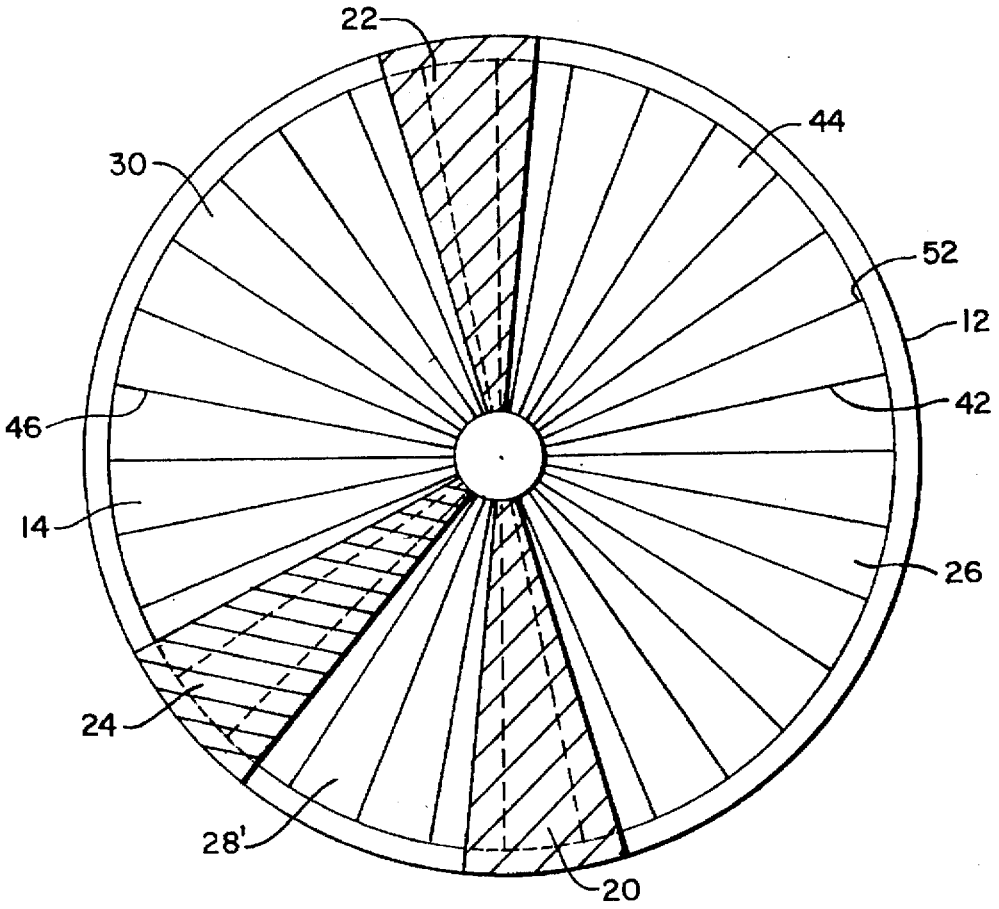
FIG. 2 is a simplified representation of a rotor of the air preheater and housing of FIG. 1.
Figure 3:
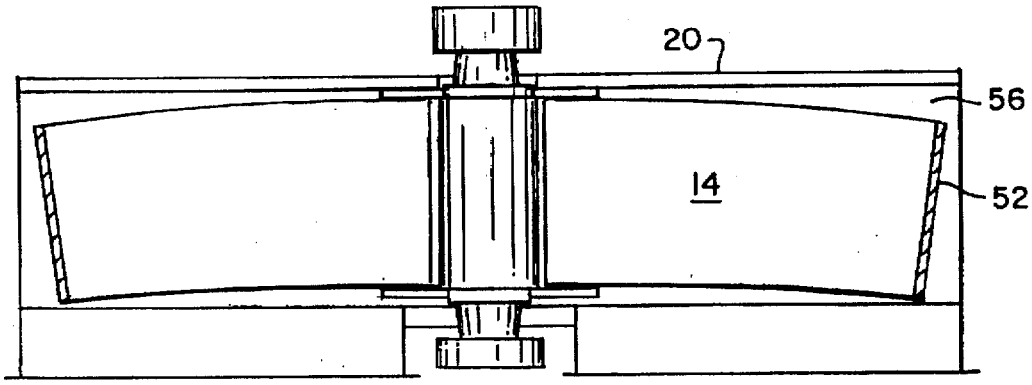
FIG. 3 is a diagrammatic representation of a rotary regenerative heat exchange apparatus experiencing rotor turndown.

In a trisector air preheater, the rotor housing 12 is divided into three sectors by the sector plates 20, 22, 24. The sectors are the flue gas sector 26, the primary air sector 28', and the secondary air sector 30. FIG. 2 is a plan view representation of a trisector air preheater rotor 14 and housing 12 illustrating the sector plates 20, 22, 24 in relation to the rotor 14 and radial seals 42. This figure illustrates the sector plates in cross-section. The rotor 14 is composed of a plurality of sectors 26, 28', 30 with each sector containing a number of basket modules 44 and with each sector being defined by the diaphragms 46. The basket modules 44 contain the heat exchange surface. Attached to the top and bottom edges of these diaphragms 46 are the radial seals 42. When the air preheater 10 is put into service, an axial temperature gradient develops from the hot end 48 of the rotor 14 to the cold end 50 of the rotor 14 as the preheater progresses from a cold non-operating condition to a hot operating condition. This axial temperature gradient causes the rotor 14 to distort. As a result, the radial seals 42 mounted on the hot end 48 of the diaphragms 46 are pulled away from the sector plates of the housing with the greater separation occurring at the outboard end 52 of the rotor 14. This opens a gap 56 (FIG. 3) which if not closed would allow flow, resulting in an undesired intermingling of the gas and the air.

Figure 5:
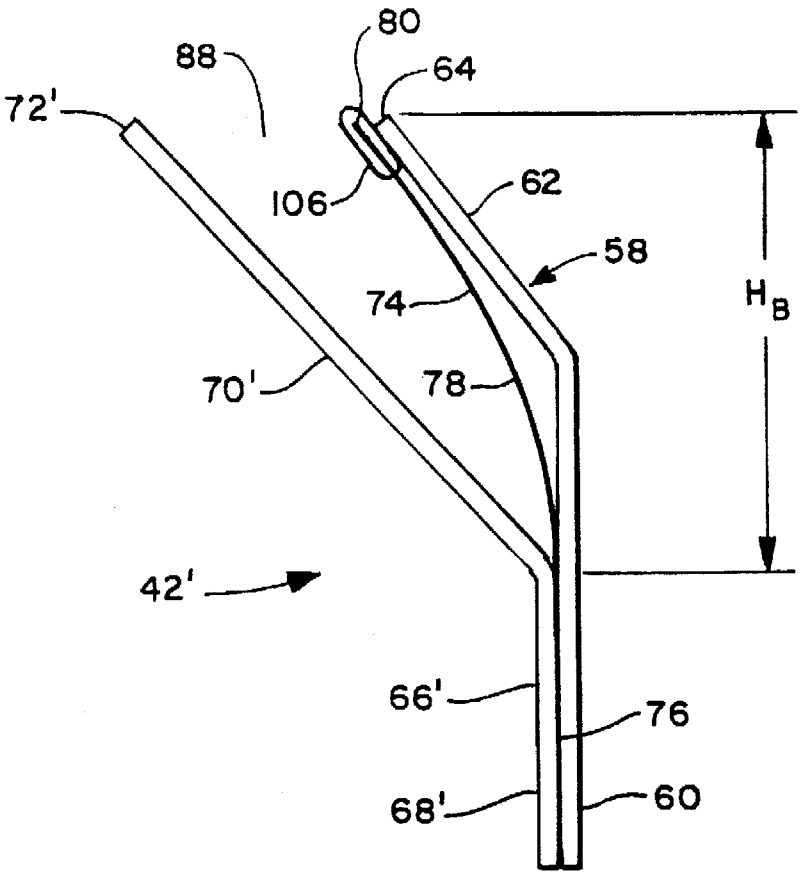
FIG. 5 is an enlarged end elevational view showing a second embodiment of the radial seal assembly of the present invention.
Figure 4:
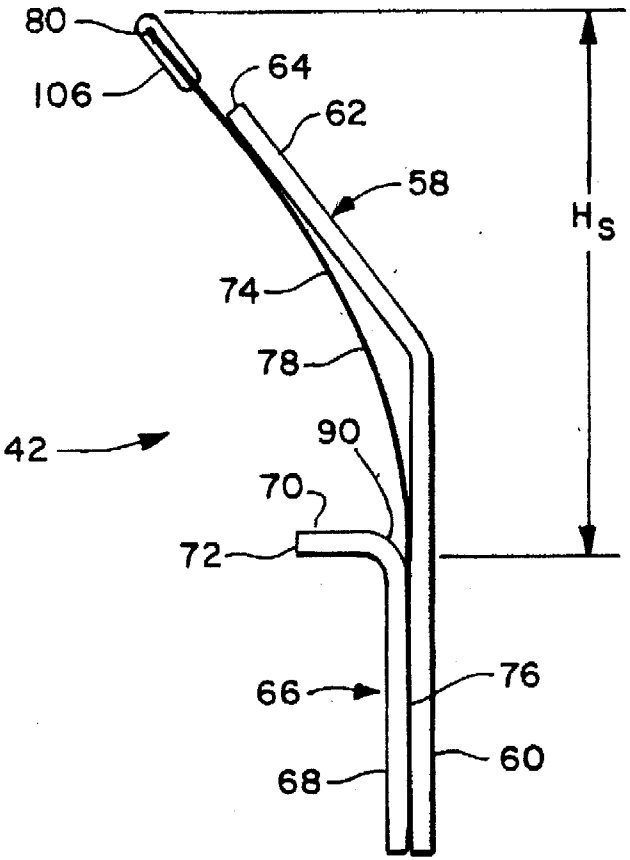
FIG. 4 is an enlarged end elevational view showing a first embodiment of the radial seal assembly of the present invention.

As shown in FIGS. 4 and 5, each radial sealing assembly (42, 42') of the present invention comprises a rigid back support leaf 58 having a base portion 60 and an extended portion 62 extending outwardly from the base portion 60 to a distal edge 64. A rigid forward support leaf 66, 66' has a base portion 68, 68' and an extended portion 70, 70' extending outwardly from the base portion 68, 68' to a distal edge 72, 72'. A flexible sealing strip 74 made of flow impervious resilient material has a base portion 76 and an extended portion 78 extending outwardly from the base portion 76 to a distal edge 80. The base portion 60 of the back support leaf 58 and the base portion 68, 68' of the forward support leaf 66, 66' are disposed substantially collaterally in closely spaced relationship. The base portion 76 of the flexible sealing strip 74 is fixedly sandwiched, or clamped, between the base portions 60, 68, 68' of the back support leaf 58 and the forward support leaf 66, 66'. The base portions 60, 68, 68', 76 of the back and forward support leaves 58, 66, 66' and the flexible sealing strip 74 may be mounted together by any of a number of well known means. The back and forward support leaves 58, 66, 66' and the flexible sealing strip 74 radially extend from an outboard end 82 of the diaphragm 46 to an inboard end 84 of the diaphragm 46.

Figure 6A:
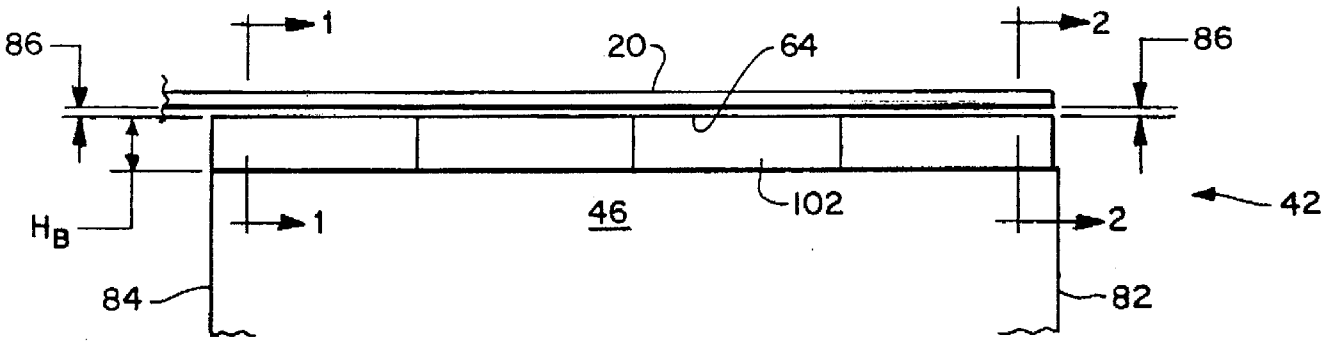
FIG. 6A is an enlarged side elevational view showing the radial seal assembly of FIG. 5 and a portion of the sector plate in a cold condition.

The extended portion 62 of the back support leaf 58 extends outwardly from the base portion 60 thereof and defines a height $H_B$ that is uniform from the outboard end 82 of the diaphragm 46 to the inboard end 84 of the diaphragm 46. The height $H_B$ has a predetermined value such that distal edge 64 of the back support leaf 58 and the sealing surface of a sector plate 20, 22, 24 define a gap 86 when the preheater 10 is in the cold condition (FIG. 6A). As an example, this gap 86 may have a width of about 0.03125 inches. The extended portion 62 of the back support leaf 58 extends outwardly from the base portion 60 at an acute angle, to a direct radial extension of the base portion 60 in a direction counter to the direction of rotation of the rotor 14. The angle will have a value selected for the specific application. It is expected that an angle from 5° to 25° will provide the proper pretension on the flexible sealing strip for any particular application. The extended portion 62 of the back support leaf 58 engages the extended portion 78 of the flexible sealing strip 74 and biases the sealing strip 74 in a direction counter to the direction of rotation. This bias imposes a pretension on the sealing strip 74 such that the sealing strip 74 resists deflection caused by air to gas differential pressures, thereby eliminating a source of gaps that commonly occur in conventional air preheaters.

In the embodiment 42' shown in FIG. 5, the extended portion 70' of the rigid forward support leaf 66' extends outwardly from the base portion 68' and is directed away from the extended portion 62 of the back support leaf 58 to provide a gap 88 therebetween. The extended portion 78 of the flexible sealing strip 74 extends outwardly from its base portion 76 between the extended portions 70', 62 of the forward and back support leaves 66', 58 into the gap 88 therebetween with a tipped portion and the distal edge 80 extending outwardly beyond the distal edges 72', 64 of the forward support leaf 66' and the back support leaf 58. As disclosed in U.S. Pat. No. 4,593,750, assigned to the assignee of the subject application, the outward portion of the back support leaf serves to limit the backward movement of the distal edge of the flexible sealing strip.

In the embodiment shown in FIG. 4, the extended portion 70 of the rigid forward support leaf 66 extends outwardly from the base portion 68 at a right angle. The enclosed gap 88 formed by the forward and back support leaves 66', 58 of the embodiment 42' shown in FIG. 5 is eliminated in this design to prevent ash and other particulate matter from collecting in the radial seal assembly. The bend 90 formed between the base portion 68 and the extended portion 70 of the forward support leaf 66 is radiused to facilitate flexure of the resilient sealing strip 74.

The flexible sealing strip comprises 74 a flow impervious resilient material. Preferably, the flexible sealing strip 74 is composed of 15-5 or 17-4 stainless steel that has been heat treated to give a yield strength of 170 Ksi, minimum, at 75° F. The higher yield strength allows the sealing strip 74 to be flexed to a greater degree without permanent deformation and provides a longer life to the sealing strip 74. The distal edge 80 of the sealing strip 74 defines the height $H_s$ of the extended portion 78 of the sealing strip 74. As viewed in FIG. 7A, the sealing strip tapers radially such that the height $H_s'$ of the sealing strip 74 at the outboard end 82 of the diaphragm 46 is greater than the height $H_s''$ of the sealing strip 74 at the inboard end 84 of the diaphragm 46. As an example, the height $H_s'$ of the sealing strip 74 at the outboard end 82 may be as much as (but not limited to) 1.250 inches greater than the height $H_s''$ of the sealing strip 74 at the inboard end 84.

Figure 9:
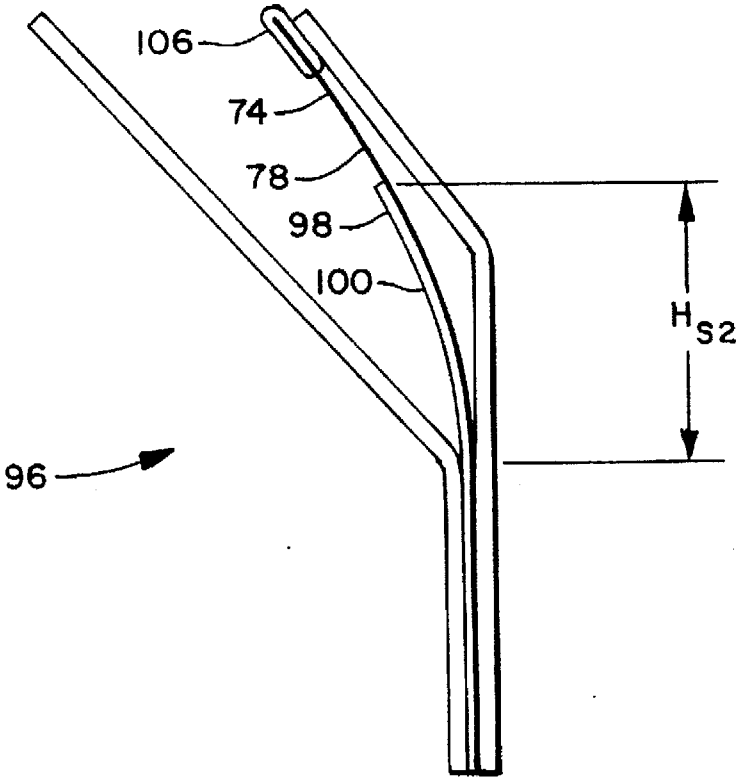
FIG. 9 is an enlarged end elevational view showing a fourth embodiment of the radial seal assembly of the present invention.
Figure 8:
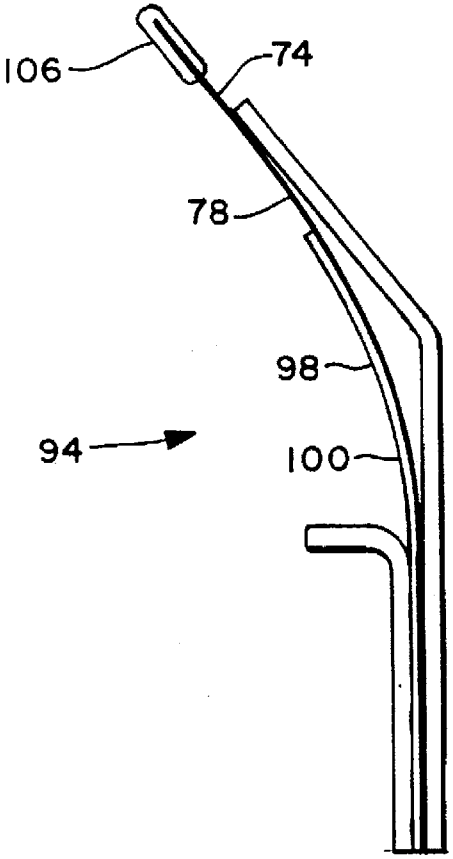
FIG. 8 is an enlarged end elevational view showing a third embodiment of the radial seal assembly of the present invention.

The maximum width of the gap 86 between the distal edge 64 of the back support leaf 58 and the sealing surface of the sector plate 20, 22, 24 that may be bridged by the sealing strip 74 is limited by the arcuate shape imposed on the sealing strip 74 by the back support leaf bias. A second, or more, sealing strip 98 may be added to the radial seal assembly 94, 96 (FIGS. 8 and 9) to impose a counter bias on the first sealing strip 74, thereby allowing the first sealing strip 74 to bridge a wider gap. Calculations have shown that the maximum gap that may be bridged by a single sealing strip 74 is approximately 0.5 inches and that this maximum gap may be increased up to (but not limited to) 1.25 inches by adding sealing strip(s) 98 to the assembly. Preferably, the height $H_{s2}$ of the extended portion 100 of each additional sealing strip 98 is less than the height Hs of the extended portion 78 of the first sealing strip 74. The additional sealing strips may have a constant height from inboard end to outboard end or taper in the same manner as the first sealing strip 74.

Figure 7A:
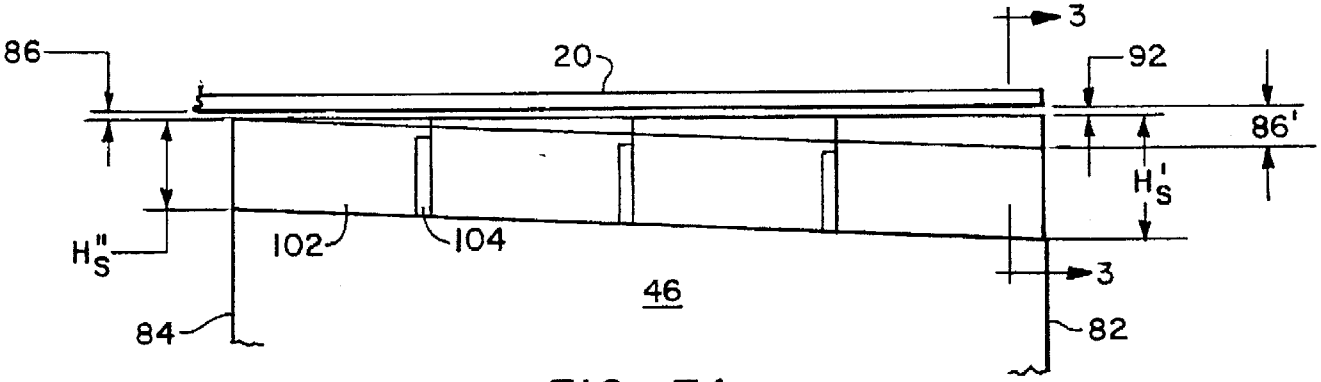
FIG. 7A is an enlarged side elevational view showing the radial seal assembly of FIG. 5 and a portion of the sector plate in a hot condition and FIG. 7B is a cross section view of the radial seal assembly and portion of the sector plate of FIG. 7A taken through line 3—3.

Preferably, the sealing strip 74 is composed of a plurality of sealing strip segments 102, FIGS. 6A and 7A. The use of sealing strip segments 102 reduces the effect of the twisting force imposed on the sealing strip 74 when the sealing strip 74 is flexed by the sector plate 20, 22, 24. As shown in FIG. 7A, the edges 104 of the sealing strip segments 102 may overlap to provide mutual support and eliminate gaps between the sealing strip segments. The distal edge 80 of the sealing strip 74 may be enclosed in a protective tip cover 106 to prevent premature failure due to edge fracturing, FIGS. 4, 5, 8 and 9. Preferably, the tip cover 106 is composed of 400 stainless steel and is mounted to the sealing strip 74 by spot welds.

Figure 6C:
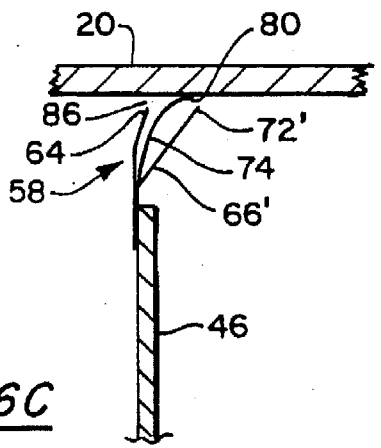
FIG. 6C is a cross section view of the radial seal assembly and portion of the sector plate of FIG. 6A taken through line 2—2.
Figure 6B:
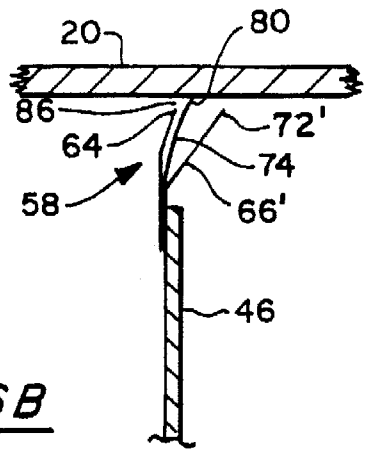
FIG. 6B is a cross section view of the radial seal assembly and portion of the sector plate of FIG. 6A taken through line 1—1.

As shown in FIG. 6A, the distal edge 64 of the back support leaf extended portion 62 and the distal edge 72' of the forward support leaf extended portion 70' are substantially parallel to the sealing surface of the sector plate 20, 22, 24 when the air preheater is in the cold condition. For example, the gap 86 between the distal edges 64, 72' of the back support leaf extended portion 62 and the forward support leaf extended portion 70' and the sealing surface of the sector plate 20, 22, 24 may be approximately 0.03125 inches in width. At least a portion of the distal edge 80 of the sealing strip 74 engages the sealing surface of the sector plate 20, 22, 24 whereby the sealing strip is flexed by this engagement. Generally, the outboard portion of the sealing strip 74 is highly flexed and the inboard portion of the sealing strip 74 is lightly flexed, or not at all, due to the taper of the sealing strip 74, as shown in FIGS. 6B and 6C.

Figure 7B:
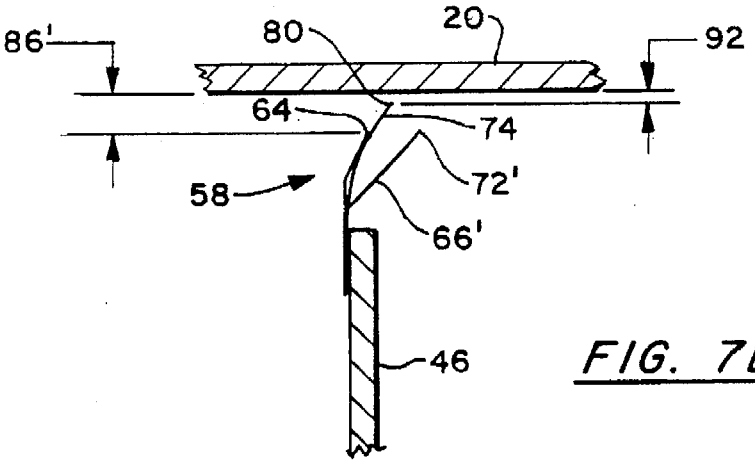

As the air preheater 10 progresses from a cold condition to a hot condition on startup, the resulting rotor turndown causes the gap 86' between the outboard end of the distal edges 64, 72' of the back support leaf 58 and the forward support leaf 66' to increase (FIGS. 7A, 7B). As the width of this portion of the gap 86' increases, the flexure of the portion of the sealing strip 74 located in the portion of the gap 86' is decreased. When the air preheater is in the hot condition, the gap 86 between the distal edges 64, 72' of the back support leaf extended portion 62 and the forward support leaf extended portion 70' has a tapered shape wherein the width of the gap 86' is greatest at the outboard end, as shown in FIG. 7A. The tapered shape of the sealing strip 74 allows the sealing strip 74 to partially bridge the gap 86 wherein a gap 92 remains between the distal edge 80 of the sealing strip extended portion 78 and the sector plate 20, 22, 24. For example, the gap 92 may have a value of approximately 0.03125 inches when feasible at specified operating temperatures. At temperatures lower than the specified operating temperatures an interference condition may occur.

I claim:

1. A radial seal assembly for use in a rotary regenerative air preheater including a rotor housing, a rotor located in the rotor housing having a plurality of circumferentially spaced radially extending diaphragms forming compartments in the rotor, the diaphragms having a cold end, a hot end and inboard and outboard end portions, and sector plates on both axial ends of the preheater dividing the preheater into a flue gas sector and at least one air sector, the preheater progressing from a cold condition to a hot condition upon startup, the radial seal assembly comprising:

a rigid first support leaf attached to the hot end of each diaphragm, radially extending from an inboard end to an outboard end, the first support leaf having a base portion and an extended portion extending outwardly therefrom to a distal edge, the distal edge defining a height wherein the height is substantially uniform from the inboard end to the outboard end; and a flexible first sealing strip attached to the hot end of each diaphragm, radially extending from an inboard end to an outboard end, the first sealing strip being made of flow impervious resilient material and having a base portion fixedly mounted adjacent the base portion of the first support leaf and an extended portion extending outwardly therefrom to a distal edge, the distal edge defining a height wherein the height decreases from the outboard end to the inboard end.

2. The radial seal assembly of claim 1 wherein the height of the first support leaf has a predetermined value wherein the distal edge of the first support leaf and the sector plate define a gap when the preheater is in the cold condition.

3. The radial seal assembly of claim 2 wherein the height of the first sealing strip has a predetermined value wherein at least a portion of the distal edge of the first sealing strip contacts the sector plate when the preheater is in the cold condition.

4. The radial seal assembly of claim 1 wherein the height of the first sealing strip at the inboard end has a predetermined value wherein the distal edge of the first sealing strip and the sector plate define a gap when the preheater is in the hot condition.

5. The radial seal assembly of claim 4 wherein at least a portion of the distal edge of the first sealing strip contacts the sector plate when the preheater is in the cold condition.

6. The radial seal assembly of claim 1 wherein the first support leaf biases the first sealing strip whereby the first sealing strip is pretensioned to resist deflection due to gas-air pressure differentials.

7. The radial seal assembly of claim 1 further comprising a rigid second support leaf radially extending from an inboard end to an outboard end, the second support leaf having a base portion fixedly mounted adjacent the base portion of the first sealing strip wherein the base portion of the first sealing strip is sandwiched between the base portion of the first support leaf and the base portion of the second support leaf, and an extended portion extending outwardly therefrom to a distal edge, the distal edge defining a height wherein the height is substantially uniform from the inboard end to the outboard end.

8. The radial seal assembly of claim 7 wherein the height of the second support leaf has a predetermined value wherein the distal edge of the second support leaf and the sector plate define a gap when the preheater is in the cold condition.

9. The radial seal assembly of claim 7 further comprising a flexible second sealing strip extending from an inboard end to an outboard end, the second sealing strip having a base portion fixedly sandwiched between the base portion of the second support leaf and the base portion of the first sealing strip and an extended portion extending outwardly therefrom to a distal edge, the distal edge defining a height wherein the height of the second sealing strip is less than the height of the first sealing strip.

10. The radial seal assembly of claim 9 wherein the distal edge of the first sealing strip and the sector plate define a gap and wherein the second sealing strip biases the first sealing strip whereby the maximum width of the gap that may be bridged by the first sealing strip is increased.

11. The radial seal assembly of claim 1 further comprising cap means for protecting the distal end of the first sealing strip.

12. The radial seal assembly of claim 1 wherein the sealing strip comprises a plurality of sealing strip segments.

13. The radial seal assembly of claim 12 wherein each of said sealing strip segments comprises first and second end portions, the second end portion of each sealing strip segment overlapping the first end portion of each adjacent sealing strip segment.

14. The radial seal assembly of claim 1 wherein the sealing strip is composed of alloy material having a high strength at elevated temperatures.

15. The radial seal assembly of claim 12 wherein the first sealing strip extends from an inboard segment to an outboard segment and the height of the extended portion of the outboard segment is substantially 0.1875 inches greater than the height of the extended portion of the inboard segment.

16. A radial seal assembly for use in a rotary regenerative air preheater including a rotor housing, a rotor located in the rotor housing having a plurality of circumferentially spaced radially extending diaphragms forming compartments in the rotor, the diaphragms having a cold end, a hot end, an inboard end portion, and an outboard end portion, and sector plates on both axial ends of the preheater dividing the preheater into a flue gas sector and at least one air sector, the preheater progressing from a cold condition to a hot condition upon startup, the radial seal assembly comprising a flexible sealing strip attached to the hot end of each diaphragm, radially extending from an inboard end to an outboard end, the sealing strip being made of flow impervious resilient material and having a base portion and an extended portion extending outwardly therefrom to a distal edge, the distal edge defining a height wherein the height decreases from the outboard end to the inboard end, wherein the sealing strip contacts and is flexed by the sector plate at least at the outboard end when the preheater is in the cold condition and wherein the distal edge and the sector plate define a gap when the preheater is in the hot condition.

* * * * *